US011295888B2

(12) United States Patent
Inaba et al.

(10) Patent No.: US 11,295,888 B2
(45) Date of Patent: Apr. 5, 2022

(54) REACTOR

(71) Applicants: AutoNetworks Technologies, Ltd., Mie (JP); Sumitomo Wiring Systems, Ltd., Mie (JP); Sumitomo Electric Industries, Ltd., Osaka (JP)

(72) Inventors: Kazuhiro Inaba, Mie (JP); Kouji Nishi, Mie (JP); Kouhei Yoshikawa, Mie (JP)

(73) Assignees: AutoNetworks Technologies, Ltd., Yokkaichi (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 428 days.

(21) Appl. No.: 16/483,168

(22) PCT Filed: Jan. 29, 2018

(86) PCT No.: PCT/JP2018/002646

§ 371 (c)(1),
(2) Date: Aug. 2, 2019

(87) PCT Pub. No.: WO2018/150853

PCT Pub. Date: Aug. 23, 2018

(65) Prior Publication Data

US 2020/0005986 A1 Jan. 2, 2020

(30) Foreign Application Priority Data

Feb. 15, 2017 (JP) ..... JP2017-026483

(51) Int. Cl.
*H01F 27/255* (2006.01)
*H01F 37/00* (2006.01)
*H01F 27/02* (2006.01)

(52) U.S. Cl.
CPC ..... *H01F 27/255* (2013.01); *H01F 37/00* (2013.01)

(58) Field of Classification Search
USPC ..... 336/233, 192, 221, 90
See application file for complete search history.

(56) References Cited

U.S. PATENT DOCUMENTS

2012/0200382 A1* 8/2012 Hejny ..... H01F 3/10 336/212
2015/0364240 A1* 12/2015 Demersseman ..... H01F 27/245 336/178
2017/0005566 A1* 1/2017 Tombelli ..... H02M 7/44

FOREIGN PATENT DOCUMENTS

JP 2006-344867 A 12/2006
JP 2006344867 * 12/2006
JP 2009-033055 A 2/2009

OTHER PUBLICATIONS

International Search Report, Application No. PCT/JP2018/002646, dated Mar. 13, 2018. ISA/Japan Patent Office.

* cited by examiner

*Primary Examiner* — Shawki S Ismail
*Assistant Examiner* — Kazi S Hossain
(74) *Attorney, Agent, or Firm* — Honigman LLP

(57) ABSTRACT

A reactor includes: a coil including a first winding portion and a second winding portion formed by winding a winding wire, such that axes of the winding portions are parallel; and a magnetic core including: a first inner core portion arranged in the first winding portion; a second inner core portion arranged in the second winding portion; and outer core portions that are arranged outside of the winding portions and couple both inner core portions. A specification of a constituent material of the first inner core portion and a specification of a constituent material of the second inner core portion are different, and the second inner core portion is configured such that alternating-current loss of the second inner core portion and the second winding portion is smaller than alternating-current loss of the first inner core portion and the first winding portion.

11 Claims, 3 Drawing Sheets

REACTOR

CROSS-REFERENCE TO RELATED APPLICATIONS

This application is the U.S. national stage of PCT/JP2018/002646 filed on Jan. 29, 2018, which claims priority of Japanese Patent Application No. JP 2017-026483 filed on Feb. 15, 2017, the contents of which are incorporated herein.

TECHNICAL FIELD

The present disclosure relates to a reactor.

BACKGROUND

A reactor is one component of a circuit for performing a voltage step-up operation and a voltage step-down operation. JP 2009-033055A discloses, as a reactor suitable for an in-vehicle converter, a reactor including: a coil that includes a pair of winding portions formed by winding a winding wire, such that axes of the winding portions are parallel; and a core that is constituted by a magnetic material and is combined in a ring shape. The core includes: two coil arrangement portions (corresponding to inner core portions) arranged inside of the winding portions; and two exposed portions (corresponding to outer core portions) that are arranged outside of the winding portions and couple the two coil arrangement portions. The divided pieces forming the coil arrangement portions and the exposed portions are bonded with an adhesive, and the core is an integral object with no gaps.

In a reactor that includes a coil including the above-described two winding portions and a ring-shaped magnetic core arranged inside and outside of the winding portions, it is desired that a temperature difference between the two winding portions is reduced.

As the installation state of the reactor, an installation state is possible in which one winding portion is sufficiently cooled by a cooling mechanism included in the installation target of the reactor, but the other winding portion is not sufficiently cooled. The two winding portions are conventionally of the same specification. Specifically, the winding portions are composed of the same type of material, and are formed by winding winding wires with the same conductor cross-sectional area and the same shape into spiral shapes with the same shape, the same size, and the same number of windings. Also, conventionally, the coil arrangement portions and exposed portions of the magnetic core are of the same specification. That is, the coil arrangement portions are composed of the same type of material, and have the same shape and the same size. In a reactor in which both winding portions and both coil arrangement portions are of the same specification in this manner, if the installation state is such that the above-described other winding portion is not sufficiently cooled, the other winding portion will reach a higher temperature than the one winding portion, and the temperature difference between the two winding portions may become large. If the temperature of the other winding portion becomes too high, an increase in loss of the magnetic core or the like is incurred, and therefore the current value applied to the coil needs to be set low in order to prevent such an inconvenience. Accordingly, if the temperature difference between the two winding portions can become large, and in particular, if overheating of the other winding portion can be incurred, the usage current value of the coil will be suppressed.

In view of this, an object of the present invention is to provide a reactor that can reduce a temperature difference between two winding portions included in a coil.

SUMMARY

A reactor of the present disclosure includes a coil including a first winding portion and a second winding portion formed by winding a winding wire, such that axes of the winding portions are parallel. A magnetic core includes a first inner core portion arranged in the first winding portion; a second inner core portion arranged in the second winding portion; and outer core portions that are arranged outside of the winding portions and couple both inner core portions. A specification of a constituent material of the first inner core portion and a specification of a constituent material of the second inner core portion are different, and the second inner core portion is configured such that alternating-current loss of the second inner core portion and the second winding portion is smaller than alternating-current loss of the first inner core portion and the first winding portion.

Advantageous Effects of the Present Disclosure

A reactor of the above-described present disclosure can reduce a temperature difference between two winding portions included in a coil.

DETAILED DESCRIPTION OF PREFERRED EMBODIMENTS

Figure 1:
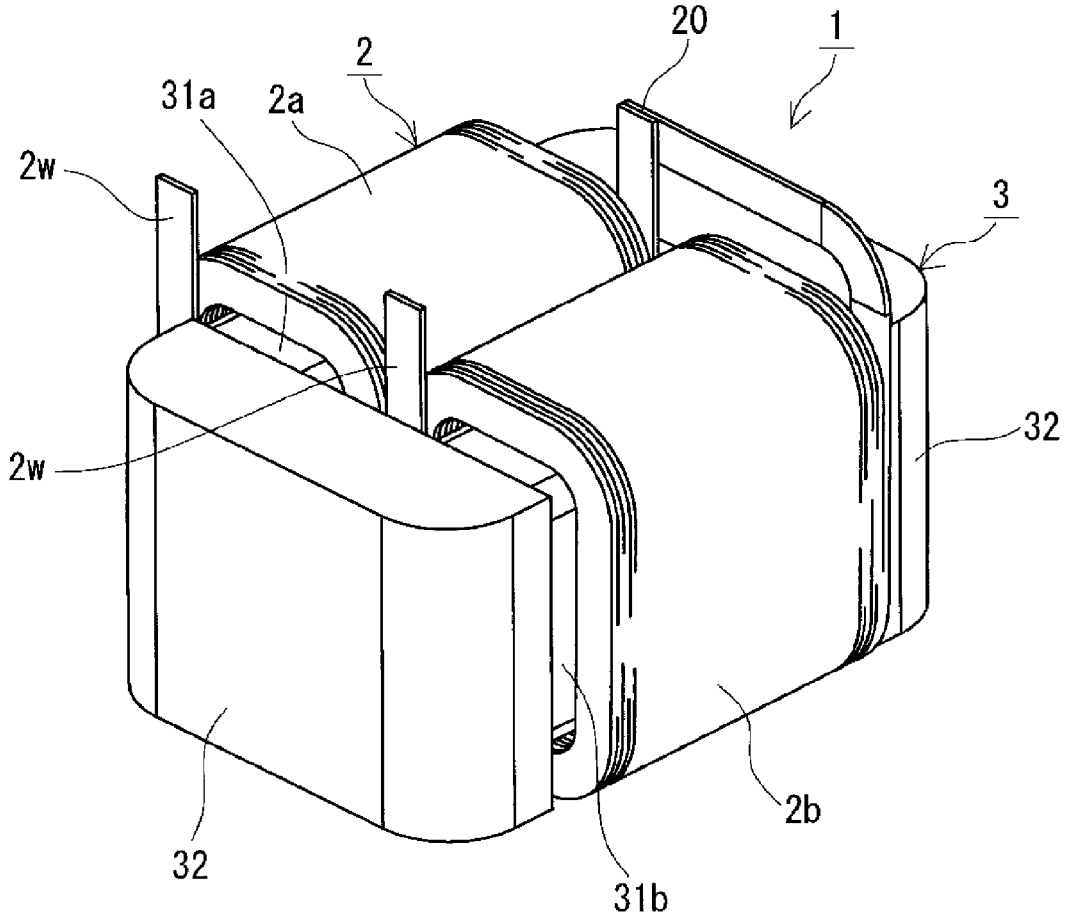
FIG. 1 is an overall perspective view showing an example of a reactor of an embodiment.

First, embodiments of the present invention will be listed and described.

A reactor according to one aspect of the present invention includes a coil including a first winding portion and a second winding portion formed by winding a winding wire, such that axes of the winding portions are parallel. A magnetic core includes a first inner core portion arranged in the first winding portion; a second inner core portion arranged in the second winding portion; and outer core portions that are arranged outside of the winding portions and couple both inner core portions. A specification of a constituent material of the first inner core portion and a specification of a constituent material of the second inner core portion are different, and the second inner core portion is configured such that alternating-current loss of the second inner core portion and the second winding portion is smaller than alternating-current loss of the first inner core portion and the first winding portion.

The specifications of the constituent materials include the components of the constituent materials (types (compositions) of the magnetic materials, presence or absence of non-magnetic materials such as resin, etc.), and the sizes of the constituent materials (if a powder composed of a magnetic material (magnetic powder) is included, the average particle diameter of the magnetic powder, etc.).

Alternating-current copper loss of the inner core portion and the winding portion refers to the loss obtained by adding the iron loss of the inner core portion and the alternating-current copper loss of the winding portion.

At least one of the first inner core portion and the second inner core portion can include a gap.

According to the above-described reactor, the temperature difference between the two winding portions included in the coil is likely to be reduced. Specifics are as follows.

For example, it is assumed that the constituent material of the second inner core portion (hereinafter referred to in some cases as "second material") is composed of a component with a lower iron loss than the constituent material of the first inner core portion (hereinafter referred to in some cases as "first material"). In this case, the iron loss of the second inner core portion is smaller than the iron loss of the first inner core portion. Alternatively, for example, it is assumed that the second material and the first material include a powder composed of the same type of magnetic material, and that the powder of the second material is finer than that of the first material. In this case, the eddy current loss of the second inner core portion is smaller than the eddy current loss of the first inner core portion, and as a result, the iron loss of the second inner core portion is smaller than the iron loss of the first inner core portion. In both of these two cases, even if both winding portions are of the same specification, alternating-current loss between the second inner core portion and the second winding portion (hereinafter referred to in some cases as "second alternating-current loss") is smaller than the alternating-current loss between the first inner core portion and the first winding portion (hereinafter referred to in some cases as "first alternating-current loss").

Alternatively, for example, it is assumed that the second inner core portion does not include a gap, and the first inner core portion includes a gap. In this case, the alternating-current copper loss of the first winding portion is likely to become larger than the alternating-current copper loss of the second winding portion due to magnetic flux leakage from the gap portion, although this depends on the types of the second material and the first material. For this reason, even if both winding portions are of the same specification as described above, and the magnetic material included in the first inner core portion is a component with a lower iron loss than the magnetic material included in the second inner core portion, the second alternating-current loss can be made smaller than the first alternating-current loss.

By adjusting the specification of the second material, the specification of the first material, and the like with consideration given to the alternating-current loss as described above, the second alternating-current loss can be made smaller than the first alternating-current loss in both cases. Consequently, when current is applied to the coil, the total heat generation amount obtained based on the second alternating-current loss can be made smaller than the total heat generation amount of the first alternating-current loss. That is, a temperature increase can be reduced by making it less likely that the second inner core portion and the second winding portion generate heat.

In the above-described reactor, the specification of the constituent material of the second inner core portion and the specification of the constituent material of the first inner core portion differ such that the second alternating-current loss is smaller than the first alternating-current loss. If this kind of above-described reactor is installed in an installation target with a difference in cooling performance, for example, the first inner core portion and the first winding portion are arranged on a side with a high cooling performance, and the second inner core portion and the second winding portion are arranged on a side with a low cooling performance. At this time, the first inner core portion and the first winding portion are more likely to generate heat, and the temperature is likely to increase, but since they are sufficiently cooled by the installation target, the temperature increase is reduced. On the other hand, the second inner core portion and the second winding portion are not sufficiently cooled by the installation target, but since they are not likely to relatively generate heat, a temperature increase is reduced. Accordingly, even if installed in an installation target with a difference in cooling performance, the above-described reactor can reduce the temperature difference between the two winding portions, and preferably, a uniform temperature is likely to be achieved.

As an example of the above-described reactor, a mode is given in which a magnetic material included in the first inner core portion is a material with a higher saturation magnetic flux density than a magnetic material included in the second inner core portion.

Many magnetic materials with a high saturation magnetic flux density have a large iron loss. For this reason, the first inner core portion can have a higher saturation magnetic flux density than that of the second inner core portion, and the second inner core portion can have a lower iron loss than the first inner core portion. Accordingly, with the above-described mode, even if the reactor is installed in the above-described installation target with different cooling performances, the temperature difference between the two winding portions can be further reduced. Also, the first inner core portion with a high saturation magnetic flux density is likely to reduce the cross-sectional area of the magnetic path, and based on this aspect, it is possible to achieve a smaller size and a lighter weight.

As an example of the reactor described above, in which a magnetic material with a high saturation magnetic flux density is included in the above-described first material, a mode is given in which a magnetic path cross-sectional area of the first inner core portion is smaller than a magnetic path cross-sectional area of the second inner core portion.

With the above-described mode, the cross-sectional area of the magnetic path of the first inner core is small, and thus it is possible to achieve a smaller size and a lighter weight as described above. Also, as the inverse to this, it is possible to make the cross-sectional area of the magnetic path of the second inner core portion even larger, and thus increase the heat dissipation surface area (heat dissipation density) of the second inner core portion, whereby the temperature increase of the second inner core portion is likely to be reduced. Accordingly, even if the reactor is installed in the above-described installation target with different cooling performances, the temperature difference between the two winding portions can be further reduced.

As an example of the above-described reactor, a mode is given in which the first inner core portion includes a core piece composed of a pressed powder molded body, and the second inner core portion includes a core piece composed of a molded body of a composite material including a magnetic powder and a resin.

For example, upon comparing a pressed powder molded body using powder composed of the same type of magnetic material and a molded body of a composite material, the iron loss of the molded body of the composite material is smaller. This kind of second inner core portion has a smaller iron loss than the first inner core portion. Accordingly, with the above-described mode, even if the reactor is installed in the above-described installation target with different cooling performances, the temperature difference between the two winding portions can be further reduced. Also, the molded body of the composite material can be given an even lower loss by, for example, increasing the resin content. In this case, the temperature increase of the second inner core portion is likely to be reduced. In the pressed powder molded body, the saturation magnetic flux density can be increased by raising the content of the magnetic material with respect to the composite material. In this case, it is possible to achieve a reduction in the size and weight of the reactor by reducing the size and weight of the first inner core as described above.

As an example of the reactor according to (2) or (3) above, in which a magnetic material with a high saturation magnetic flux density is included in the above-described first material, a mode is given in which the first inner core portion and the second inner core portion both include a core piece composed of a pressed powder molded body or a core piece composed of a molded body of a composite material including a magnetic powder and a resin.

With the above-described mode, in addition to the effect of being able to reduce the temperature difference between the above-described two winding portions, in a mode that includes a core piece composed of a pressed powder molded body, the saturation magnetic flux density is high as described above, and a reduction in size and weight is likely to be achieved. With a mode including a core piece composed of a composite material, as described above, it is easier to reduce loss, and the temperature increase in both winding portions is likely to be reduced.

As an example of the above-described reactor, a mode is given in which the first inner core portion and the second inner core portion both include a core piece composed of a molded body of a composite material including a resin and a magnetic powder of the same type, and the magnetic powder included in the second inner core portion has a smaller average particle diameter than the magnetic powder included in the first inner core portion.

With the above-described mode, a core piece composed of a composite material is included, and therefore, as described above, it is easier to reduce loss, and the temperature increase in both winding portions is likely to be reduced. The smaller the particle diameter of the magnetic powder included in the composite material is, the more likely the iron loss, and in particular, the eddy current loss, is to decrease. The second inner core portion including this kind of fine magnetic power has a smaller iron loss than the first inner core portion. Accordingly, with the above-described mode, even if the reactor is installed in the above-described installation target with different cooling performances, the temperature difference between the two winding portions can be further reduced.

Hereinafter, embodiments of the present embodiment will be described specifically with reference to the drawings. Identical reference numerals in the drawings indicate identically-named objects.

Embodiment 1

A reactor 1 and a magnetic core 3 included in the reactor 1 of Embodiment 1 will be described with reference to FIGS. 1 to 3.

Overall Configuration

The reactor 1 of Embodiment 1 includes: a coil 2 including a first winding portion 2*a* and a second winding portion 2*b*, which are formed by winding a winding wire 2*w* as shown in FIG. 1; and a ring-shaped magnetic core 3 that is arranged inside and outside of the winding portions 2*a* and 2*b*. Both winding portions 2*a* and 2*b* are provided aligned side-by-side such that the axes of the winding portions 2*a* and 2*b* are parallel. The magnetic core 3 includes: a first inner core portion 31*a* that is arranged inside of the first winding portion 2*a*; a second inner core portion 31*b* that is arranged inside of the second winding portion 2*b*; and two outer core portions 32 and 32 that are arranged outside of the winding portions 2*a* and 2*b* and couple the two inner core portions 31*a* and 31*b*. The outer core portions 32 and 32 are arranged so as to connect the two inner core portions 31*a* and 31*b* arranged separate from each other such that the axes of the inner core portions 31*a* and 31*b* are parallel, and thus the magnetic core 3 is assembled in a ring shape, whereby when the coil 2 is excited, a closed magnetic path is formed.

In the reactor 1 of Embodiment 1, the specification of the constituent material of the first inner core portion 31*a* and the specification of the constituent material of the second inner core portion 31*b* are different. Also, the second inner core portion 31*b* is constituted such that the alternating-current loss between the second inner core portion 31*b* and the second winding portion 2*b* (second alternating-current loss) is smaller than the alternating-current loss between the first inner core portion 31*a* and the first winding portion 2*a* (first alternating-current loss). Typically, the magnetic material included in the second inner core portion 31*b* and the magnetic material included in the first inner core portion 31*a* are of different types, or the second inner core portion 31*b* includes a greater amount of resin. It is easy to make the iron loss of this kind of second inner core portion 31*b* smaller than that of the first inner core portion 31*a*. Therefore, the second alternating-current loss can be made smaller than the first alternating-current loss. Consequently, the heat generation amount based on the second alternating-current loss can be made smaller than the heat generation amount based on the first alternating-current loss. In a sense, the second inner core portion 31*b* and the second winding portion 2*b* can be made less likely to generate heat than the first inner core portion 31*a* and the first winding portion 2*a*. With this kind of reactor 1, the temperature difference between the two winding portions 2*a* and 2*b* can be reduced, even if the second inner core portion 31*b* and the second winding portion 2*b* are not sufficiently cooled compared to the first inner core portion 31*a* and the first winding portion 2*a*.

Hereinafter, the magnetic core 3 will mainly be described in detail.

Coil

The coil 2 of this example includes: the cylindrical first winding portion 2*a* and second winding portion 2*b*, which are formed by winding two winding wires 2*w* and 2*w* into spiral shapes as shown in FIG. 1; and a bonding portion 20 that is formed by bonding end portions on one side of the two winding wires 2*w* and 2*w*. The coil 2 is an integral object that is manufactured by forming the winding portions 2*a* and 2*b* using the winding wires 2*w* and 2*w*, arranging them aligned side-by-side as described above, bending the end portions on one side of the winding wires 2*w* and 2*w* that extend from the winding portions 2*a* and 2*b* as appropriate, electrically connecting the leading end portions, and forming the bonding portion 20. Various types of welding, soldering, brazing, and the like can be used in the connection. Both of the end portions on the other side of the winding wires 2*w* are pulled out in an appropriate direction from the winding portions 2*a* and 2*b*, terminal fittings (not shown) are attached as appropriate, and the end portions are electrically connected to an external apparatus such as a power source (not shown).

The winding portions 2*a* and 2*b* of this example are of the same specification. Specifically, the winding wires 2*w* and 2*w* are both wire materials of the same specification, and are covered rectangular wires, or so-called enamel wires, which include: a rectangular wire conductor composed of copper or the like; and an insulating covering that is composed of polyamide imide or the like and covers the outer periphery of the conductor. The winding portions 2*a* and 2*b* are both quadrangular cylindrical edgewise coils with rounded corner portions, and have the same size, shape, winding direction, and number of turns. It is sufficient that the coil 2 is of the same specification in which the two winding portions 2*a* and 2*b* are included arranged side-by-side, and a known specification can be used. For example, it is possible to use a coil or the like that includes: the winding portions 2*a* and 2*b* formed using one continuous winding wire; and a coupling portion formed by a portion interposed between the winding portions 2*a* and 2*b* in the winding wire. The specifications of the winding wire and the winding portions 2*a* and 2*b* can be changed as appropriate.

Magnetic Core

First, the structure of the magnetic core 3 will be described, and next, a specific combination of constituent materials, the first inner core portion 31*a* and the second inner core portion 31*b* will be described in order.

Structure

Figure 2:
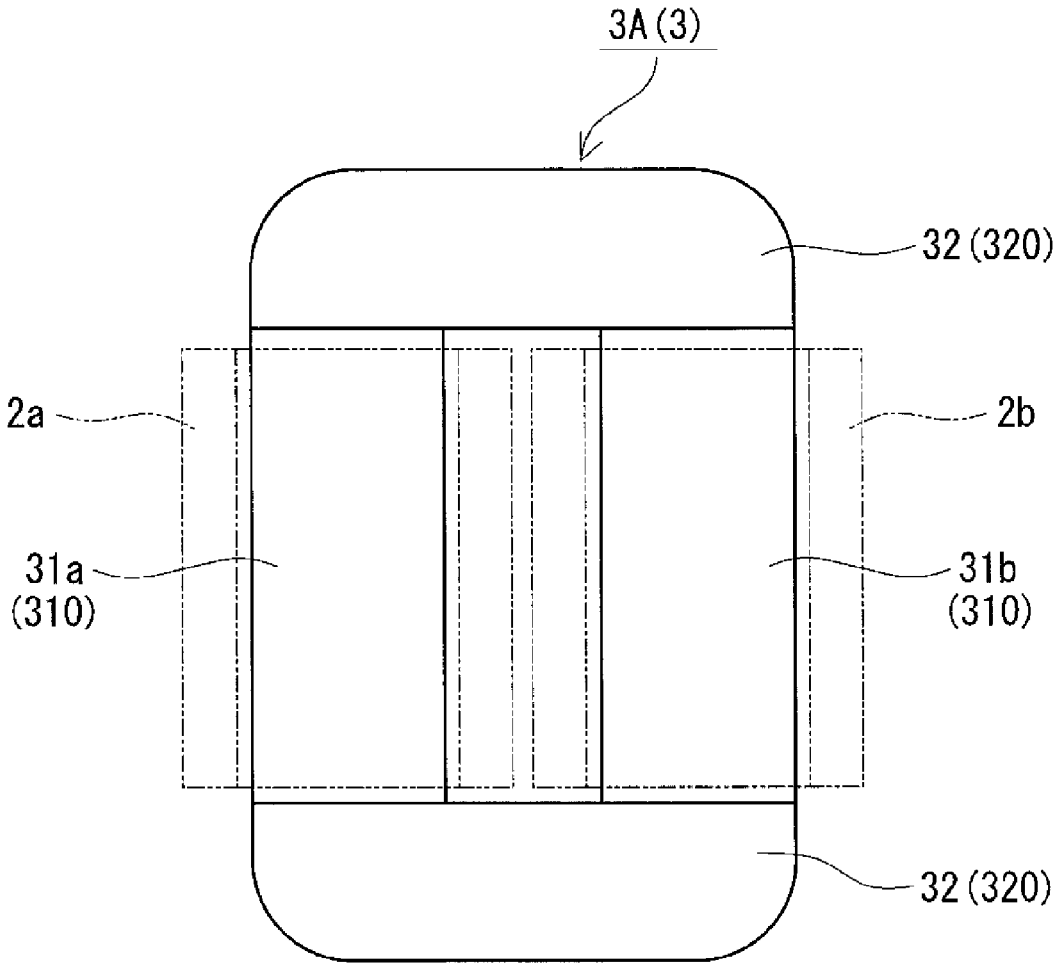
FIG. 2 is a plan view showing an example of a magnetic core included in a reactor of an embodiment.
Figure 3:
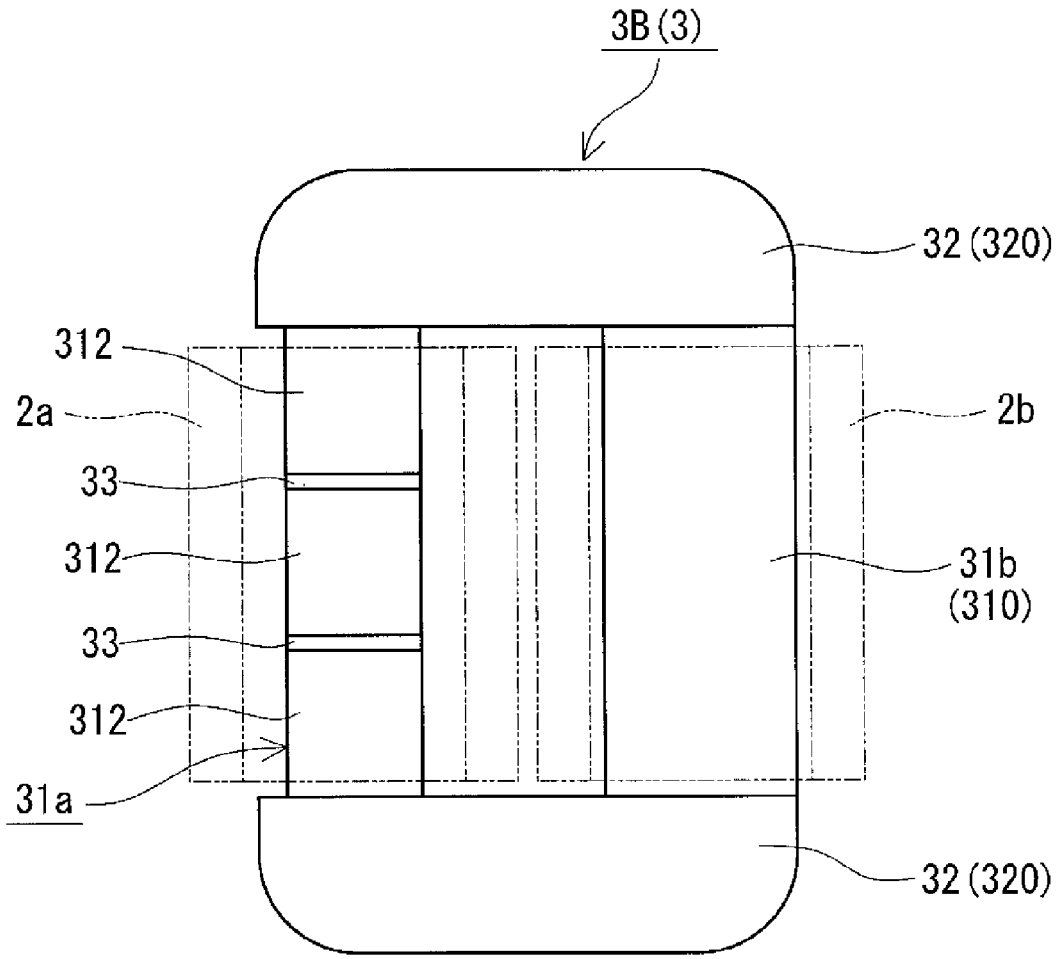
FIG. 3 is a plan view showing another example of a magnetic core included in a reactor of an embodiment.

Typically, a mode is given in which the magnetic core 3 is a set that includes multiple core pieces including magnetic materials as shown in FIGS. 2 and 3 (in FIG. 2, core pieces 310 and 320, and in FIG. 3, core pieces 310, 312, and 320), and is formed by assembling these core pieces in a ring shape. Also, a mode in which no gap is included between the adjacent core pieces as with the magnetic core 3A shown in FIG. 2, and a mode in which a gap is included between the adjacent core pieces as with the magnetic core 3B shown in FIG. 3 are given. FIG. 3 illustrates a case in which a gap is included in at least one of the first inner core portion 31*a* and the second inner core portion 31*b*, and in particular, a case in which at least one gap material 33 is included in the first inner core portion 31*a*.

With the mode shown in FIG. 2 in which the gap is not included, the inner core portions 31*a* and 31*b* are composed of individual core pieces 310 and 310, and the two outer core portions 32 and 32 are composed of individual core pieces 320 and 320. In this case, the core pieces 310, 310, 320, and 320 can each be integrally-formed components, which is excellent for manufacturability of the core pieces and the workability of assembling the magnetic core 3.

In the mode shown in FIG. 3 in which the gap is included, for example, the first inner core portion 31*a* is composed of multiple core pieces 312 and at least one gap material 33, and the second inner core portion 31*b* and the two outer core portions 32 and 32 are all composed of the individual core pieces 310, 320, and 320. Alternatively, the inner core portions 31*a* and 31*b* are composed of multiple core pieces and at least one gap material (not shown).

The core pieces 310, 312, and 320 are molded bodies formed by being molded into appropriate shapes and sizes. In FIGS. 1 to 3, cuboid core pieces are illustrated. Specifically, a core piece composed of a pressed powder molded body, a core piece composed of a molded body of a composite material including magnetic powder and resin, a core piece composed of a layered body obtained by layering a plate material composed of a soft magnetic material such as a silicon steel plate, a core piece composed of a sintered body such as a ferrite core, and the like are examples thereof.

Examples of the pressed powder molded body include a pressed powder molded body obtained by compression-molding mixed powder including magnetic powder, a binder, and an appropriate lubricant into a predetermined shape, and a pressed powder molded body obtained by further carrying out thermal processing after molding. Resin or the like can be used as the binder, and examples of the content thereof include about 30 vol % or less, furthermore 20 vol % or less, and about 15 vol % or less. A pressed powder molded body that does not include a binder such as resin can be obtained by using thermal processing to eliminate the binder or obtain a thermally-modified object. It is easier to increase the content of the magnetic material in the pressed powder molded body compared to the molded body of the composite material. Examples of the content of the magnetic material in the pressed powder molded body include more than 80 vol %, and furthermore 85 vol % or more. In the case of including the same type of magnetic material, the pressed powder molded body has a greater amount of the magnetic material compared to the molded body of the composite material, and therefore it is easier to obtain a core piece with a high saturation magnetic flux density. Since the saturation magnetic flux density is high, the size of the core piece composed of the pressed powder molded body is easy to make smaller while satisfying a predetermined impedance. Accordingly, the core piece composed of the pressed power molded body is easier to make compact compared to the core piece composed of the molded body of the composite material. Also, since the saturation magnetic flux density is high, the reactor 1 including the core piece composed of the compressed powder molded body can be suitably used in a large-current application (e.g., 100 A or more, and furthermore 200 A or more). However, due to the fact that magnetic saturation is more likely to occur when the current is large, it is preferable to include the above-described gap in the case of including a core piece composed of the pressed powder molded body.

Examples of the molded body of the composite material include a molded body manufactured using an appropriate molding method such as injection molding or cast molding. The molded body of the composite material can also be a molded body directly molded inside of the winding portions 2*a* and 2*b*, using the winding portions 2*a* and 2*b* of the coil 2 as a mold (see later-described Variations (1) and (2)). Since the molded body of the composite material has resin interposed between the powder particles of the magnetic powder, it is easy to reduce the iron loss, and in particular, the eddy current loss, compared to a pressed powder molded body, and it is easy to obtain a core piece with low loss. That is, it is easy to obtain a core piece in which the heat generation amount based on iron loss is low and in which temperature increase is not likely to occur. Since loss is low, a reactor 1 that includes a core piece composed of a molded body of a composite material is likely to reduce iron loss even if used in a high-frequency application (e.g., 20 kHz or more, furthermore 25 kHz or more, and 30 kHz or more). In addition, the molded body of the composite material can be formed easily even if it has a complex shape, and has excellent manufacturability. Also, the magnetic core 3 including the core piece composed of the molded body of the composite material can have a mode of not including the above-described gap, although this depends on the usage current value.

Examples of the gap material 33 include a gap material including a non-magnetic material such as alumina or resin, or a gap material including a mixed material including magnetic powder and a non-magnetic material such as resin, the mixed material having a lower relative permeability than the above-described core piece. FIG. 3 illustrates a plate material composed of the above-described non-magnetic material and the like as the gap material 33. An air gap can also be used as another gap. If a gap is not included as with the magnetic core 3A shown in FIG. 2, alternating-current copper loss caused by magnetic flux leakage from the gap portion is easily reduced, and heat generation of the winding portions 2*a* and 2*b* based on the alternating-current copper loss is easily reduced. If a gap is included as with the magnetic core 3B shown in FIG. 3, it is possible to suppress magnetic saturation of the magnetic core 3B even if a large current is applied. The gap need only be provided as needed if it is desired that magnetic saturation is reduced or suppressed.

Constituent Material

Examples of the constituent materials of the above-described core piece include the constituent material composed of substantially only a magnetic material (e.g., a pressed powder molded body, a stacked body, a sintered body, etc.), and the constituent material composed of a magnetic material and resin (e.g., a composite material, etc.).

Examples of the magnetic material include a metal or a non-metal that is a soft magnetic material. Examples of the metal include: pure iron composed substantially of Fe; an iron-based alloy including various additive elements and composed of Fe and inevitable impurities in the remaining portions; an iron group metal other than Fe; and an alloy thereof. Examples of the iron-based alloy include: an Fe—Si alloy, an Fe—Si—Al alloy, an Fe—Ni alloy, and an Fe—C alloy. Examples of the non-metal include ferrite. Pure iron tends to have a high saturation magnetic flux density compared to an iron-based alloy. The iron-based alloy tends to have low iron loss compared to pure iron.

In the pressed powder molded body, typically, the magnetic powder used in the raw material is plastically deformed through compression molding. With the molded body of the composite material, typically, the magnetic powder used as the raw material is dispersed in resin, and the magnetic powder substantially maintains the components, sizes, shapes, and the like of the powder used as the raw material. The average particle diameter of the magnetic powder in the composite material is, for example, 1 μm or more and 1000 μm or less. The smaller the above-described average particle diameter is, the smaller the iron loss, and particularly, the eddy current loss, that can occur in the powder particles is, and the easier it is to obtain a low-loss core piece. If lower loss is desired, the above-described average particle diameter is preferably 1 μm or more and 100 μm or less, and furthermore 1 μm or more and 50 μm or less. The greater the above-described average particle diameter is, the easier it is to make the relative permeability large, and the easier it is to reduce the magnetic flux leakage from the composite material. Also, the magnetic powder with a large particle diameter is easy to handle and has excellent workability in a manufacturing process. The above-described average particle diameter is obtained by, for example, removing resin and the like from the composite material to extract only the magnetic powder, and measuring the magnetic powder using a commercially-available particle size measurement apparatus. Put simply, a cross-section of the molded body of the composite material is obtained, a diameter of a circle corresponding to the area of a powder particle in the cross-section is used as the particle diameter of that powder particle, and the average value of the particle diameters of 10 or more powder particles present in the cross-section can be used as the above-described average particle diameter.

A core piece composed of the above-described pressed powder molded body or stacked body can include, in addition to the above-described magnetic material, an insulating material that is interposed between magnetic particles or between plate materials composed of a soft magnetic material. Due to the powder particles and the plate materials being insulated from each other by the insulating material, it is possible to reduce iron loss, and in particular, eddy current loss, and a low-loss core piece can be obtained. The magnetic powder included in the above-described composite material can be composed of coated particles in which an insulating coating is included in the outer peripheries of the powder particles composed of the magnetic material. In this case, the insulating material is reliably present between the powder particles, and therefore a lower-loss core piece can be obtained.

Examples of the resin included in the composite material include thermosetting resin, thermoplastic resin, room-temperature-curable resin, and low-temperature-curable resin. Examples of the thermoplastic resin include: polyphenylene sulfide (PPS) resin; polytetrafluoroethylene (PTFE) resin; liquid crystal polymer (LCP); polyamide (PA) resins such as nylon 6 and nylon 66; polybutylene terephthalate (PBT) resin; and acrylonitrile butadiene styrene (ABS) resin. Examples of the thermosetting resin include: unsaturated polyester resin; epoxy resin; urethane resin; and silicone resin. In addition, BMC (bulk molding compound) obtained by mixing calcium carbonate and glass fiber into unsaturated polyester, millable silicone rubber, millable urethane rubber, and the like can also be used.

Examples of the content of magnetic powder in the composite material include: 30 vol % or more and 80 vol % or less, and furthermore 50 vol % or more and 75 vol % or less. Examples of the content of resin in the composite material include: 10 vol % or more and 70 vol % or less, and furthermore, 20 vol % or more and 50 vol % or less. Also, the composite material can contain a filler powder composed of a non-magnetic and non-metal material such as alumina or silica, in addition to the magnetic powder and the resin. Examples of the content of the filler powder include: 0.2 mass % or more and 20 mass % or less; 0.3 mass % or more and 15 mass % or less; and 0.5 mass % or more and 10 mass % or less. The greater the content of the magnetic powder is, the easier it is to increase the saturation magnetic flux density and reduce the size. In the case where the magnetic powder is composed of metal, if the content of the magnetic powder is large, it is easy to increase the heat dissipation property. On the other hand, the greater the content of the resin is, the higher the insulation will be due to the resin being interposed between the powder particles of the magnetic powder, and thus it is easy to reduce eddy current loss, and loss is low. In the case of containing a filler powder, a reduction of loss due to an improvement in the insulation, an improvement in the heat dissipation property, and the like can be expected.

Combination

Examples of specific combinations will be given below, with distinctions made from the above-described structure.

(1) The first inner core portion 31*a* and the second inner core portion 31*b* both include core pieces composed of pressed powder molded bodies.

(2) The first inner core portion 31*a* includes a core piece composed of a pressed powder molded body, and the second inner core portion 31*b* includes a core piece composed of a molded body of a composite material including magnetic powder and resin.

(3) The first inner core portion 31*a* and the second inner core portion 31*b* both include core pieces composed of molded bodies of a composite material including magnetic powder and resin.

If a mode is used in which a gap is included in both the first inner core portion 31*a* and the second inner core portion 31*b*, which include core pieces composed of pressed powder molded bodies, in (1) described above, and in which a gap is included in the first inner core portion 31*a* including a core piece composed of the pressed powder molded body in (2) described above (see FIG. 3), magnetic saturation is not likely to occur. In a mode in which many core pieces composed of a composite material are included in (3) described above, magnetic saturation is less likely to occur, and therefore it is possible to use a mode in which no gaps are included (see FIG. 2).

Typical examples of both modes according to (1) to (3) above include a mode in which the magnetic material included in the first inner core portion 31*a* and the magnetic material included in the second inner core portion 31*b* are different types of materials. For example, there is a mode in which the magnetic material included in the first inner core portion 31*a* is a material with a higher saturation magnetic flux density than the magnetic material included in the second inner core portion 31*b*. Many magnetic materials with high saturation magnetic flux densities have a large iron loss. For this reason, the first inner core portion 31*a* can have a higher saturation magnetic flux density than that of the second inner core portion 31*b*, and the second inner core portion 31*b* can have a lower iron loss than the first inner core portion 31*a*. Accordingly, in this mode, the second alternating-current loss can be made smaller than the first alternating-current loss. Pure iron is an example of a magnetic material with a relatively high saturation magnetic flux density, and an iron-based alloy is an example of a magnetic material with a relatively low saturation magnetic flux density. Table 1 shows an exemplary combination of structures and compositions of magnetic materials for the first inner core portion 31*a* and the second inner core portion 31*b*. Samples No. 1, No. 2-1, and No. 3-1 correspond to exemplary combinations of the mode in which one material has a high saturation magnetic flux density. Examples of other combinations include a combination in which a magnetic material included in the first inner core portion 31*a* is an iron alloy (e.g., Fe—Si alloy) with a relatively high saturation magnetic flux density, and the magnetic material included in the second inner core portion 31*b* is an iron-based alloy (e.g., Fe—Si—Al alloy) with a relatively low saturation magnetic flux density.

TABLE 1

| Sample | First inner core portion | | Second inner core portion | |
|---|---|---|---|---|
| No. | Structure | Magnetic material | Structure | Magnetic material |
| 1 | Pressed powder | Pure iron | Pressed powder | Iron-based alloy |
| 2-1 | Pressed powder | Pure iron | Composite material | Iron-based alloy |
| 2-2 | Pressed powder | Iron-based alloy | Composite material | Pure iron |
| 2-3 | Pressed powder | Pure iron | Composite material | Pure iron |
| 2-4 | Pressed powder | Iron-based alloy | Composite material | Iron-based alloy |
| 3-1 | Composite material | Pure iron | Composite material | Iron-based alloy |
| 3-2 | Composite material | Pure iron (coarse particles) | Composite material | Pure iron (fine particles) |
| 3-3 | Composite material | Iron-based alloy (coarse particles) | Composite material | Iron-based alloy (fine particles) |

Note that in Sample No. 2-2, the second inner core portion 31*b* includes a core piece composed of a composite material including resin, and includes pure iron with a high saturation magnetic flux density. For this reason, depending on the content of the pure iron in the composite material and the like, the iron loss of the second inner core portion 31*b* including the core piece composed of the composite material is greater than that of the first inner core portion 31*a* including the core piece composed of the pressed powder molded body in some cases. In such a case, due to the first inner core portion 31*a* including a gap, the alternating-current copper loss of the first winding portion 2*a* caused by the magnetic flux leakage from the gap portion increases, and as a result, the second alternating-current loss can be made smaller than the first alternating-current loss.

If the first inner core portion 31*a* includes a core piece including a magnetic material with a high saturation magnetic flux density as described above, the core piece is not likely to be magnetically saturated, and therefore the core piece can be made smaller. For example, it is possible to use a mode in which the magnetic path cross-sectional area of the first inner core portion 31*a* is smaller than the magnetic path cross-sectional area of the second inner core portion 31*b*, as shown in FIG. 3. In this mode, since the first inner core portion 31*a* is compact and lightweight, the magnetic core 3B including the first inner core portion 31*a* is compact and lightweight. Also, due to the first inner core portion 31*a* being small, it is possible to obtain a wide space between the first winding portion 2*a* and the first inner core portion 31*a*, the alternating-current copper loss of the first winding portion 2*a* caused by the magnetic flux leakage from the first inner core portion 31*a* is reduced, and thus it is easy to reduce a temperature increase of the first winding portion 2*a*. However, due to the first inner core portion 31*a* being small, the heat dissipation area (heat dissipation density) reduces in size, and from this viewpoint, it is thought that the temperature is likely to increase. On the other hand, the second inner core portion 31*b* can make the magnetic path cross-sectional area greater than that of the first inner core portion 31*a*, and therefore the heat dissipation area (heat dissipation density) is increased, which makes it easy to reduce the temperature increase. As a result, this mode can also make the second alternating-current loss smaller than the first alternating-current loss.

In the mode of (2) above, in which the structures of the core pieces are different, and the mode of (3) above, in which the sizes of the magnetic powders can be made different, the magnetic material included in the first inner core portion 31*a* and the magnetic material included in the second inner core portion 31*b* can be the same type of material.

As a specific example of the mode of (2) described above, as shown in Sample No. 2-3 (or No. 2-4) of Table 1, the first inner core portion 31*a* includes a core piece composed of a pressed powder molded body of pure iron (or an iron alloy), and the second inner core portion 31*b* includes a core piece composed of a molded body of a composite material including a magnetic powder of pure iron (or an iron alloy). The composite material including resin is more likely to have a lower iron loss than the pressed powder molded body. For this reason, if magnetic materials of the same type are included, the second inner core portion 31*b* can be given a lower iron loss than the first inner core portion 31*a* by making the structures of the core pieces different. As a result, in this case as well, the second alternating-current loss can be made smaller than the first alternating-current loss.

As a specific example of the mode of (3) described above, as indicated in Samples No. 3-2 and No. 3-3 of Table 1, both the first inner core portion 31*a* and the second inner core portion 31*b* have a mode in which core pieces composed of molded bodies of composite materials including the same type of magnetic powder (pure iron in No. 3-2 and an iron alloy in No. 3-3) and resin are included, and the magnetic powder included in the second inner core portion 31*b* has a smaller average particle diameter than the magnetic powder included in the first inner core portion 31*a*. The finer the magnetic powder is, the easier it is to reduce the iron loss, and in particular, the eddy current loss, as described above. For this reason, the second inner core portion 31*b* including the fine powder can have a lower iron loss than the first inner core portion 31*a*, even if both the first inner core portion 31*a* and the second inner core portion 31*b* include core pieces composed of molded bodies of composite materials including the same type of magnetic powder. As a result, in this case as well, the second alternating-current loss can be made smaller than the first alternating-current loss.

The above-described pressed power molded bodies, the molded bodies of the composite material, the layered bodies, or the sintered bodies can be selected and used as the core pieces 320 and 320 forming the outer core portions 32 and 32. The outer core portion 32 is typically composed of the same material as the core pieces 310 and 312 included in the first inner core portion 31*a*. For example, if the core pieces 320 and 320 are molded bodies of a composite material, the magnetic core 3A does not include a gap as shown in FIG. 2. Alternatively, if the core pieces 320 and 320 are pressed powder molded bodies, the magnetic core 3B includes a gap as shown in FIG. 3.

As a method for measuring the first alternating-current loss and the second alternating-current loss, for example, the inner core portions 31*a* and 31*b* and the winding portions 2*a* and 2*b* are modeled, and a simulation is used to perform CAE (Computer Aided Engineering) analysis, or the like. In this case, it is sufficient to model the inner core portions 31*a* and 31*b* and the winding portions 2*a* and 2*b* based on the specifications (type of magnetic material, resin content, average particle diameter of magnetic powder, presence or absence of gaps, etc.) of the inner core portions 31*a* and 31*b*, the specifications (type of winding wire 2*w*, the shape, size, and number of turns of the winding portions 2*a* and 2*b*, etc.) of the winding portions 2*a* and 2*b*, and the like. Alternatively, the inner core portions 31*a* and 31*b* and the winding portions 2*a* and 2*b* are each disassembled, the respective iron losses and alternating-current copper losses are measured using a commercially-available measurement apparatus, and the measurement results are added up. If both of the winding portions 2*a* and 2*b* are of the same specification, the magnitude of the iron loss can simply be understood as the magnitude of the alternating-current loss obtained by adding the iron losses and the alternating-current copper losses, based on the difference between the types of the first material and the second material, the difference between the average particle diameter of the magnetic powder, the presence or absence of gaps, and the like.

Application

The reactor 1 of Embodiment 1 can be used as, for example, a constituent component of an in-vehicle converter (typically a DC-DC converter) to be mounted in a vehicle such as a hybrid automobile, a plug-in hybrid automobile, an electric automobile, or a fuel battery automobile, various types of converters such as a converter for an air conditioner, and a power conversion apparatus.

Main Effects

In the reactor 1 of Embodiment 1, the specification of the constituent material of the first inner core portion 31*a* and the specification of the constituent material of the second inner core portion 31*b* differ, such that the second alternating-current loss is lower than the first alternating-current loss. If this kind of reactor 1 is installed in an installation target with a difference in cooling performance, for example, the first inner core portion 31*a* and the first winding portion 2*a* are arranged on the side with the high cooling performance, and the second inner core portion 31*b* and the second winding portion 2*b* are arranged on the side with the low cooling performance. If arranged in this manner, the second inner core portion 31*b* and the second winding portion 2*b* will not be sufficiently cooled from the installation target compared to the first inner core portion 31*a* and the first winding portion 2*a*. However, it can be said that the second inner core portion 31*b* and the second winding portion 2*b* have a second alternating-current loss that is lower than the first alternating-current loss, have a smaller heat generation amount based on the second alternating-current loss, and thus are less likely to generate heat. For this reason, although there is a difference in the cooling performance as described above, the temperature difference between the two winding portions 2*a* and 2*b* can be reduced, and preferably, the temperature difference can be substantially eliminated and a uniform temperature can be achieved. Due to the temperature difference between the winding portions 2*a* and 2*b* being small, it is possible to prevent the usage temperature from being restricted due to one of the winding portions reaching an excessively high temperature. For this reason, the maximum usage temperature of the reactor 1 of Embodiment 1 can be increased, or in other words, the usage current value can be increased, and thus the reactor 1 can be used under a greater variety of conditions, and excellent versatility is achieved.

Variations

At least one of the following modifications and additions can be applied to the above-described embodiment.

(1) The coil 2 can be a molded coil including a resin molded portion that covers at least part of the surface of the winding portions 2*a* and 2*b*.

In this case, for example, if at least part of the inner circumferential surfaces of the winding portions 2*a* and 2*b* is covered with a resin molded portion, the electrical insulation between the coil 2 and the magnetic core 3 is increased due to a resin portion that is interposed between the coil 2 and the magnetic core 3 (in particular, between the winding portions 2*a* and 2*b* and the inner core portions 31*a* and 31*b*). Also, in this case, the inner core portions 31*a* and 31*b* composed of the molded bodies of the composite material can be formed through injection molding or the like, using the winding portions 2*a* and 2*b* as molds.

Examples of the constituent material of the resin molded portion include insulating resins such as the various types of thermoplastic resins and the various types of thermosetting resins described in the section "Composite Material". If non-magnetic and non-metal powder such as alumina or silica is included in the insulating resin, the heat dissipating property, the electrical insulation, and the like are improved.

(2) The coil 2 can be an integrated coil including a heat seal resin portion (not shown) that joins the adjacent turns constituting the winding portions 2*a* and 2*b*, instead of the above-described resin molded portion or in addition to the equipping of the resin molded portion.

In this case, the inner core portions 31*a* and 31*b* composed of the molded bodies of the composite material can be formed through injection molding or the like, using the winding portions 2*a* and 2*b* as molds.

(3) An interposed member (a bobbin, etc.) that is composed of the above-described insulating resin and is interposed between the coil 2 and the magnetic core 3 can be included instead of the above-described resin molded portion.

In this case, the electrical insulation between the coil 2 and the magnetic core 3 can be increased.

(4) The magnetic core 3 can be a molded core including a resin molded portion that covers at least part of the surface of the magnetic core 3, and in particular, at least part of the surfaces of the inner core portions 31*a* and 31*b*, and is composed of the above-described insulating resin.

In this case, the electrical insulation between the coil 2 and the magnetic core 3, and in particular, between the winding portions 2*a* and 2*b* and the inner core portions 31*a* and 31*b*, can be increased.

(5) Sensors (not shown) for measuring physical amounts of the reactor, such as a temperature sensor, a current sensor, a voltage sensor, and a magnetic flux sensor, are included.

If a temperature sensor is included, the temperature sensor is arranged near the second winding portion 2*b* or the second inner core portion 31*b*, which is thought to be likely to have an increased temperature.

(6) A heat dissipation plate or a heat dissipation layer is included at an exposed location of the winding wire of the winding portions 2*a* and 2*b* (in the case of a molded coil, it is included at a location exposed from the resin molded portion).

In this case, a temperature increase in both winding portions 2*a* and 2*b* is more easily reduced, and the usage current value of the coil 2 can be increased.

If the heat dissipation plate is a metal plate composed of aluminum, an aluminum alloy, or the like, the heat transmission rate will be high, and excellent heat dissipation properties will be achieved. Examples of the heat dissipation plate include a heat dissipation plate composed of a combined plate including a powder with excellent heat dissipation properties (a powder that is non-magnetic and is composed of a non-metal, such as alumina, a powder that is non-magnetic and is composed of a metal, such as aluminum, etc.), and a resin (may be an adhesive). A heat dissipation sheet or the like may also be used.

(7) A case (not shown) for housing a set including the coil 2 and the magnetic core 3 can be included. Furthermore, sealing resin for sealing the set including the coil 2 and the magnetic core 3 in the case can be included.

If the constituent material of the case is a metal such as aluminum or an aluminum alloy, an excellent heat transmission property will be achieved, the case can be used as a heat dissipation route for both winding portions 2*a* and 2*b*, and the heat dissipation property can be improved. Examples of the constituent material of the sealing resin include resins such as epoxy resin and silicone resin. Furthermore, if a resin containing a powder with the above-described excellent heat dissipation property is used, the heat dissipation property can be further improved. By including the case and the sealing resin with an excellent heat dissipation property, temperature increases in both winding portions 2*a* and 2*b* are even more easily reduced, and the usage current value of the coil 2 can be increased.

The present invention is not limited to these illustrations, is indicated by the claims, and is intended to encompass meanings equivalent to the claims and all modifications within the technical scope.

The invention claimed is:

1. A reactor comprising:

a coil including a first winding portion and a second winding portion formed by winding a winding wire, such that axes of the winding portions are parallel; and a magnetic core including: a first inner core portion arranged in the first winding portion; a second inner core portion arranged in the second winding portion; and outer core portions that are arranged outside of the winding portions and couple both inner core portions, wherein a specification of a constituent material of the first inner core portion and a specification of a constituent material of the second inner core portion are different, and the second inner core portion is configured such that alternating-current loss of the second inner core portion and the second winding portion is smaller than alternating-current loss of the first inner core portion and the first winding portion.

2. The reactor according to claim 1, wherein a magnetic material included in the first inner core portion is a material with a higher saturation magnetic flux density than a magnetic material included in the second inner core portion.

3. The reactor according to claim 2, wherein a magnetic path cross-sectional area of the first inner core portion is smaller than a magnetic path cross-sectional area of the second inner core portion.

4. The reactor according to claim 1, wherein the first inner core portion includes a core piece composed of a pressed powder molded body, and the second inner core portion includes a core piece composed of a molded body of a composite material including a magnetic powder and a resin.

5. The reactor according to claim 2, wherein the first inner core portion and the second inner core portion both include a core piece composed of a pressed powder molded body or a core piece composed of a molded body of a composite material including a magnetic powder and a resin.

6. The reactor according to claim 1, wherein the first inner core portion and the second inner core portion both include a core piece composed of a molded body of a composite material including a resin and a magnetic powder of the same type, and the magnetic powder included in the second inner core portion has a smaller average particle diameter than the magnetic powder included in the first inner core portion.

7. The reactor according to claim 2, wherein the first inner core portion includes a core piece composed of a pressed powder molded body, and the second inner core portion includes a core piece composed of a molded body of a composite material including a magnetic powder and a resin.

8. The reactor according to claim 3, wherein the first inner core portion includes a core piece composed of a pressed powder molded body, and the second inner core portion includes a core piece composed of a molded body of a composite material including a magnetic powder and a resin.

9. The reactor according to claim 3, wherein the first inner core portion and the second inner core portion both include a core piece composed of a pressed powder molded body or a core piece composed of a molded body of a composite material including a magnetic powder and a resin.

10. The reactor according to claim 2, wherein the first inner core portion and the second inner core portion both include a core piece composed of a molded body of a composite material including a resin and a magnetic powder of the same type, and the magnetic powder included in the second inner core portion has a smaller average particle diameter than the magnetic powder included in the first inner core portion.

11. The reactor according to claim 3, wherein the first inner core portion and the second inner core portion both include a core piece composed of a molded body of a composite material including a resin and a magnetic powder of the same type, and the magnetic powder included in the second inner core portion has a smaller average particle diameter than the magnetic powder included in the first inner core portion.

* * * * *